US009103552B2

(12) United States Patent
Böttcher et al.

(10) Patent No.: US 9,103,552 B2
(45) Date of Patent: Aug. 11, 2015

(54) BURNER ASSEMBLY INCLUDING A FUEL DISTRIBUTION RING WITH A SLOT AND RECESS

(75) Inventors: Andreas Böttcher, Mettmann (DE); Tobias Krieger, Oberhausen (DE); Daniel Vogtmann, Monheim (DE); Ulrich Wörz, Oviedo, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 620 days.

(21) Appl. No.: 13/512,452

(22) PCT Filed: Nov. 8, 2010

(86) PCT No.: PCT/EP2010/067000

§ 371 (c)(1),
(2), (4) Date: May 29, 2012

(87) PCT Pub. No.: WO2011/064086

PCT Pub. Date: Jun. 3, 2011

(65) Prior Publication Data

US 2012/0234010 A1 Sep. 20, 2012

(30) Foreign Application Priority Data

Nov. 30, 2009 (EP) ..... 09177514

(51) Int. Cl.

| | |
|---|---|
| ***F23D 14/58*** | (2006.01) |
| ***F23R 3/34*** | (2006.01) |
| ***F23R 3/28*** | (2006.01) |

(52) U.S. Cl.

CPC ..... *F23R 3/286* (2013.01); *F23R 3/283* (2013.01); *F23D 2211/00* (2013.01); *F23R 2900/00005* (2013.01)

(58) Field of Classification Search

CPC ..... F23R 3/34; F23R 3/286; F23R 3/28; F23R 3/14; F23R 3/04; F02C 7/22; F02C 7/222; F23D 14/24; F23D 14/64; F23D 14/58

USPC ..... 60/734, 737, 738, 739, 740, 746, 747, 60/748, 751, 804

See application file for complete search history.

(56) References Cited

U.S. PATENT DOCUMENTS

| | | | | |
|---|---|---|---|---|
| 5,524,438 | A * | 6/1996 | Johnson et al. | 60/747 |
| 5,836,164 | A * | 11/1998 | Tsukahara et al. | 60/733 |
| 6,082,111 | A | 7/2000 | Stokes | |

(Continued)

FOREIGN PATENT DOCUMENTS

| | | | |
|---|---|---|---|
| CN | 101313178 | A | 11/2008 |
| EP | 0526152 | A1 | 2/1993 |

(Continued)

*Primary Examiner* — William H Rodriguez
*Assistant Examiner* — Steven Sutherland

(57) ABSTRACT

A burner assembly having a fuel distribution ring, number of fuel nozzles which are mounted on the fuel distribution ring in the direction of low is provided. The fuel distribution ring has a ring-shaped surface in the direction of flow and wherein the fuel distribution ring center and an opposite outer outer side and wherein there is at least one slot on the surface between the fuel nozzles and the at least one slot extends on the surface from the outside to the inside. There is at least one recess arranged on the surface and the at least one recess also partially includes the outside of the fuel distributor.

20 Claims, 3 Drawing Sheets

(56) References Cited

U.S. PATENT DOCUMENTS

| | | | | |
|---|---|---|---|---|
| 6,089,025 | A * | 7/2000 | Tekriwal et al. | 60/737 |
| 6,122,916 | A * | 9/2000 | Amos et al. | 60/747 |
| 6,532,726 | B2 * | 3/2003 | Norster et al. | 60/39.281 |
| 6,634,175 | B1 | 10/2003 | Akita | |
| 8,590,311 | B2 * | 11/2013 | Parsania et al. | 60/737 |
| 8,938,978 | B2 * | 1/2015 | Bailey et al. | 60/804 |
| 8,955,328 | B2 * | 2/2015 | Bottcher et al. | 60/742 |
| 2004/0040310 | A1 | 3/2004 | Gandza | |

FOREIGN PATENT DOCUMENTS

| | | | |
|---|---|---|---|
| EP | 0924458 | A1 | 6/1999 |
| EP | 2037172 | A2 | 3/2009 |
| RU | 2258822 | C1 | 8/2005 |
| RU | 2290565 | C1 | 12/2006 |
| WO | WO 2008034227 | A1 | 3/2008 |

* cited by examiner

BURNER ASSEMBLY INCLUDING A FUEL DISTRIBUTION RING WITH A SLOT AND RECESS

CROSS REFERENCE TO RELATED APPLICATIONS

This application is the US National Stage of International Application No. PCT/EP2010/067000, filed Nov. 8, 2010 and claims the benefit thereof. The International Application claims the benefits of European Patent Office application No. 09177514.8 EP filed Nov. 30, 2009. All of the applications are incorporated by reference herein in their entirety.

FIELD OF INVENTION

The present invention relates to a burner assembly and in particular a burner assembly for gas turbines.

BACKGROUND OF INVENTION

Essential component parts of a gas turbine are a compressor, a turbine with blades and at least one combustion chamber. The blades of the turbine are arranged on a shaft extending mostly through the entire gas turbine as a blade ring, said shaft being coupled to a consumer, like for instance a generator for power generation. The shaft provided with the blades is also known as turbine rotor or rotor. Guide vane rings which are used as nozzles to conduct the working medium through the turbine are disposed between the blade rings.

During operation of the gas turbine, the combustion chamber is supplied with compressed air from the compressor. The compressed air is mixed with a fuel, for instance oil or gas, and the mixture is burnt in the combustion chamber. The hot combustion exhaust gases are finally fed to the turbine as a working medium by way of a combustion chamber exit, whereby they transfer impulses to the blades upon decompression and cooling and thus perform work. The blades are used here to optimize the impulse transmission.

A typical burner assembly for gas turbines, as described in U.S. Pat. No. 6,082,111 and as used in particular in so-called tubular combustion chambers, generally comprises an annular support with nozzle lances distributed evenly about the periphery of the ring. Fuel nozzle openings are arranged in these nozzle lances, with which fuel can be injected into an air supply duct. The fuel nozzles represent a main stage of the burner, which is used to generate a premix flame, in other words a flame in which the air and the fuel are mixed prior to ignition. In order to minimize the $NO_x$ in the flame, premix burners with leaner air-fuel mixtures, in other words with mixtures which contain relatively little fuel, are operated.

A pilot burner, which is embodied as a diffusion burner, i.e. it generates a flame, with which the fuel is directly injected into the flame without previously being mixed with air, typically extends through the center of the annular fuel distribution ring. The pilot burner, as well as being used to start up the gas turbine, is also used to stabilize the premix flame, which is frequently operated in a range of the mixing ratio of the air to fuel in order to minimize the pollutant emissions, which may result in flame instabilities without a supporting pilot burner.

With high combustion temperatures, the fuel distribution ring is characterized by a short service life.

SUMMARY OF INVENTION

It is therefore an object of the present invention to provide an advantageous burner assembly with a fuel distribution ring which has a particularly long service life. It is a further object to provide an advantageous gas turbine with such a burner assembly.

This object is achieved by a burner assembly as claimed in the claims. The object relating to the gas turbine is achieved by the specification of a gas turbine according to the claims. The dependent claims contain advantageous embodiments of the invention.

Here the burner assembly includes a fuel distribution ring and a number of fuel nozzles which are mounted on the fuel distribution ring in the flow direction. The fuel distribution ring comprises an annular surface in the flow direction. In addition, the fuel distribution ring comprises an outer inner side pointing to the ring center and an opposite outer outer side.

Since final compressor air flows from outside around the fuel distribution ring, in other words on the respective outer sides, however at up to 500° C. warmer, but cold fuel flows through its interior, which in extreme cases is at just 20° C., it was identified that as a result high thermal gradients and very high stresses associated therewith occur on the fuel distribution ring. As a result, the service life of the component is significantly influenced. In particular, high stresses occur on the surface of the fuel distribution ring.

In accordance with the invention, at least one slot is now present on the surface between the fuel nozzles. An improved heat distribution in the material of the fuel distributor is produced by this stress relief slot, as a result of which the stresses are reduced and a higher life expectancy is set. The relief slot may vary here in depth, width and length and be adjusted to the respective fuel distribution ring. The at least one slot extends on the surface from the outer side to the inner side. Stress relief is therefore ensured across a wide surface area. At least one recess is arranged on the surface. By means of the at least one recess, an optimized geometry is produced above all in conjunction with the slots, by means of which an improved heat distribution in the material of the fuel distribution ring results. On account of the improved heat distribution, locally increased stresses no longer occur and the extended service life cycles can be achieved. The stress can therefore be reduced in this region from its original figure of over 950 MPa to 600 MPa.

The at least one recess also partly includes the exterior of the fuel distribution ring. In a preferred embodiment, the at least one recess is essentially round.

In a preferred embodiment, several fuel nozzles are available, whereby a slot is present between each adjacent fuel nozzle. The entire surface ring of the fuel distribution ring is therefore covered with relief slots.

The at least one slot is preferably essentially y-shaped. Here the at least one y-shaped slot includes two arms and a leg, wherein the two arms of the essentially y-shaped slot are oriented toward the outer side of the fuel distribution ring. Alternatively or in addition, e.g. in alternating sequence, the two arms of the essentially y-shaped slot can also be oriented toward the inner side of the fuel distribution ring.

The at least one recess may comprise a radius here wherein the radius reduces when viewed in the flow direction.

The fuel distribution ring preferably includes at least one nickel alloy, in particular a nickel molybdenum alloy, or a nickel chrome iron molybdenum alloy. These alloys are particularly resistant to high temperatures.

The fuel distribution ring preferably includes at least two fuel channels for two combustion states A and B in its interior. In one advantageous embodiment, the two fuel channels include two supply connections. As a result, fuel can be fed to the fuel nozzles separately in each instance and as a function of the charging state of the machine.

The burner assembly is in particular provided in a gas turbine.

BRIEF DESCRIPTION OF THE DRAWINGS

Further features, properties and advantages of the present invention result from the subsequent description of exemplary embodiments with reference to the appended figures.

DETAILED DESCRIPTION OF INVENTION

Figure 1:
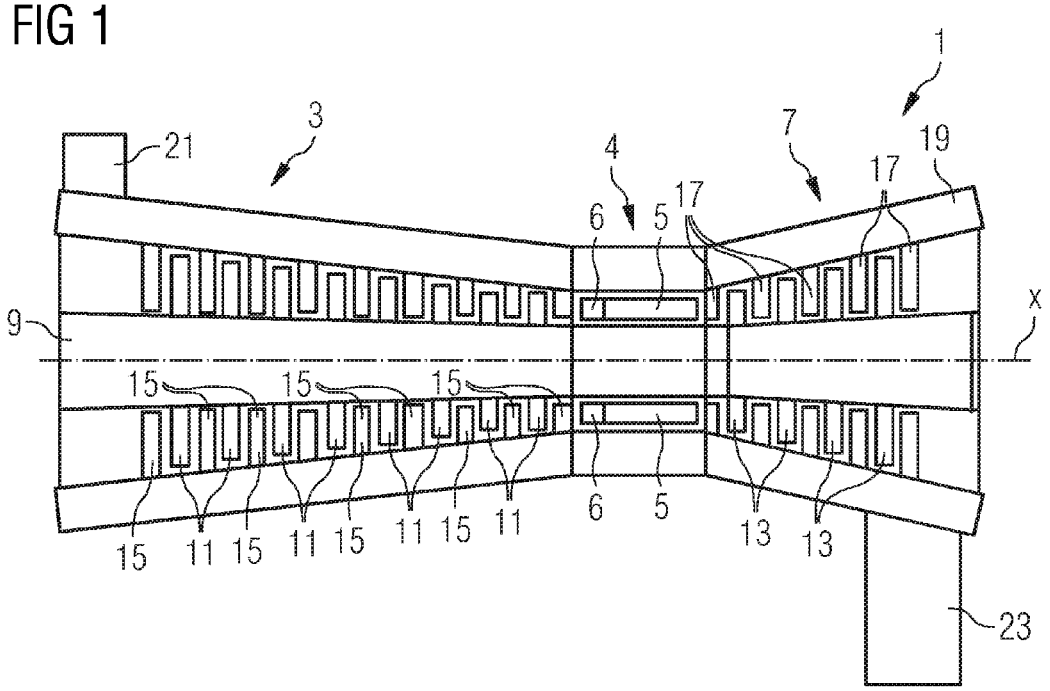
FIG. 1 shows a gas turbine in a highly schematic representation.

The structure and function of a gas turbine will be explained below with the aid of FIG. 1, which depicts a highly schematic sectional view of a gas turbine. The gas turbine 1 includes a compressor segment 3, a combustion segment 4, which, in the present exemplary embodiment, includes a plurality of tubular combustion chambers 5 with burners 6 arranged thereon, but basically can also include an annular combustion chamber, and a turbine segment 7. A rotor 9, also known as blade, extends through all the segments and supports compressor blade rings 11 in the compressor segment 3 and turbine blade rings 13 in the turbine segment 7. Rings made of compressor guide vanes 15 and/or rings made of turbine guide vanes 17 are arranged between adjacent turbine blade rings 11 and between adjacent turbine blade rings 13, which extend from a housing 19 of the gas turbine 1 radially in the direction of the rotor 9.

During operation of the gas turbine 1, air is drawn into the compressor segment 3 through an air inlet 21. The air is compressed there by the rotating compressor blades 11 and routed to the burners 6 in the combustion segment 4. In the burners 6 the air is mixed with a gaseous or liquid fuel and the mixture is combusted in the combustion chambers 5. The highly pressurized hot combustion exhaust gases are then fed to the turbine segment 7 as working medium. On their way through the turbine segment the combustion exhaust gases transmit pulses to the turbine blades 13, whereby they decompress and cool down. Finally, the decompressed and cooled-down combustion gases leave the turbine segment 7 through an exhaust pipe 23. The transmitted pulse results in a rotational movement of the rotor, which drives the compressor and a consumer, for instance a generator, to generate electrical current or an industrial working machine. The rings of turbine guide vanes 17 are used here as nozzles to conduct the working medium in order to optimize the impulse transmission to the turbine blades 13.

Figure 2:
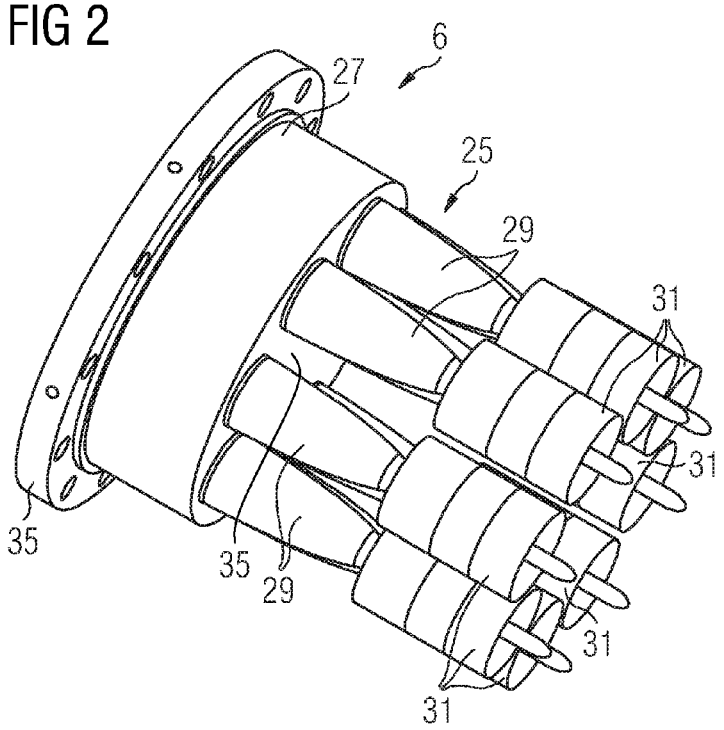
FIG. 2 shows a gas turbine burner having a burner assembly in a perspective representation.

FIG. 2 shows a perspective representation of the burner 6 of the combustion segment 4. As main components, the burner 6 includes a fuel distribution ring 27, eight fuel nozzles 29, which extend from the fuel distribution ring 27 and eight swirl generators 31 arranged in the region of the peaks of the fuel nozzles 29. The fuel distribution ring 27 and the fuel nozzles 28 together form a burner housing, through which fuel lines extend to nozzle openings, which are arranged within the swirl generators 31. The fuel nozzle 29 can be welded to the fuel distribution ring 27. The burner can be attached to fuel supply lines by way of a number of tubular connecting pieces (not shown). The burner 6 can be fastened to a tubular combustion chamber by means of a flange 35, such that the fuel nozzles 29 point towards the interior of the combustion chamber.

Although the burner 6 shown in FIG. 2 comprises eight fuel nozzles 29, it is also possible to equip the same with a different quantity of fuel nozzles 29. The number of fuel nozzles 29 may be greater or less than eight here, for instance six fuel nozzles 29 or twelve fuel nozzles 29 may exist, which each comprise a swirl generator. Furthermore, a pilot fuel nozzle is usually arranged in the center of the burner. The pilot fuel nozzle is not shown in FIG. 2 for the sake of clarity.

During the combustion process, air is routed out of the compressor through the swirl generator 31 where it is mixed with fuel. The air-fuel mixture is then combusted in the combustion zone of the combustion chamber 5 in order to form the working medium.

Figure 3:
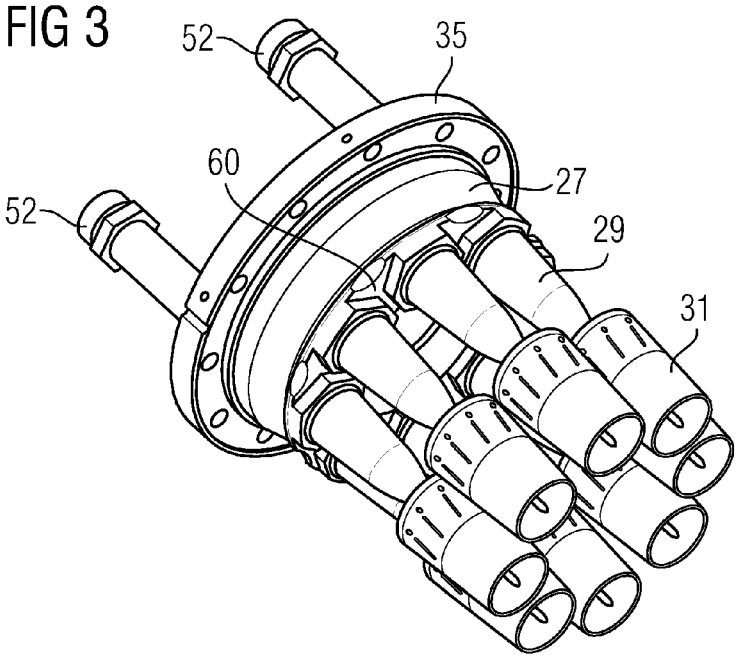
FIG. 3 shows a gas turbine burner having an inventive burner assembly in a perspective representation.
Figure 4:
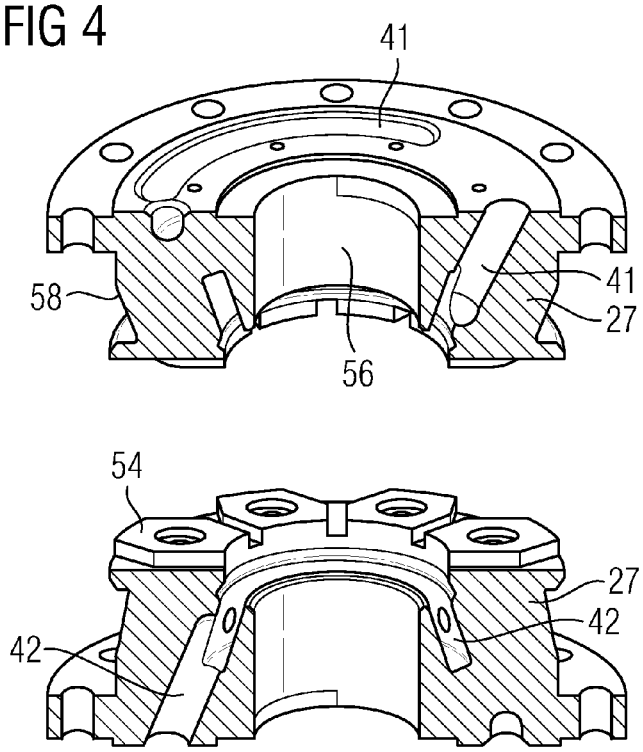
FIG. 4 shows an inventive burner assembly in a cross-sectional view

The fuel distribution ring 27 has the object of distributing the fuel to the fuel nozzles 29. Provision is to this end made for two fuel channels 41, 42 in the inside, of which each provides a number of nozzles 29 (in this specific case 4 nozzles 29 in each instance) with fuel as a stage A and a stage B (FIG. 3 and FIG. 4). The two fuel channels 41 and 42 include two supply connections 51, 52 for supplying fuel. These may also be different types of fuel. Warm compressor air at up to 500° C. flows around the fuel distribution ring 27 from the outside, but in extreme cases, cold fuel which can be at a temperature of just 20° C. may flow past the inside. As a result, very high stresses result on the fuel distribution ring 27. Above all, very high stresses occur on the surface side 45 of the fuel distribution ring 27 which faces the nozzle 29, so that the service life cannot be achieved.

A number of fuel nozzles 29 exists, which are mounted on the fuel distribution ring 27 in the flow direction. Furthermore, the fuel distribution ring 27 also comprises an annular surface 54 in the flow direction and an outer inner side 56 oriented toward the ring center and an opposite outer outer side 58.

Figure 5:
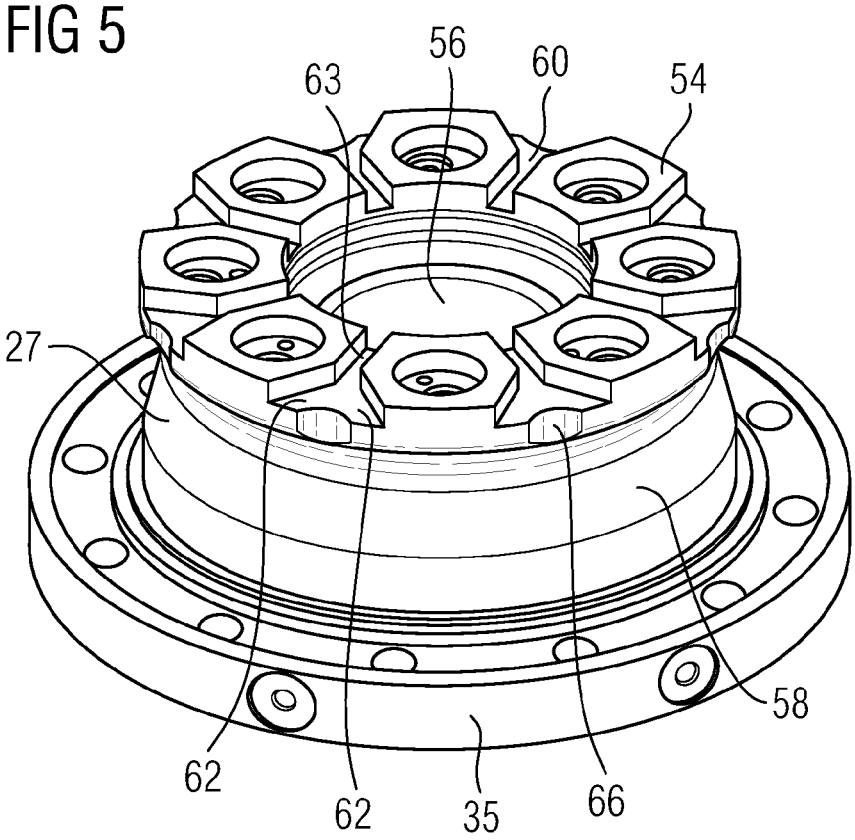
FIG. 5 shows a view of the top of an inventive burner assembly.

In accordance with the invention, at least one slot 60 is now present on the surface 45 between the fuel nozzles 29. This is essentially y-shaped (FIG. 3 and FIG. 5). Here essentially y-shaped means that all shapes are included, which are approximately evocative of the letter Y, in other words two arms 62 and one leg 63. Advantageously, all intermediate spaces on the surface 45 between the nozzles 29 are provided with such slots 60. The slot 60, and in particular the y-shaped slot 60, extends on the surface 54 from the outer side 58 to the inner side 56. The high thermal gradient can as a result therefore prevent stresses from forming during operation. This significantly increases the service life of the burner assembly, in particular of the fuel distribution ring 27.

Here the two arms 62 of the essentially y-shaped slot 60 can advantageously be arranged on the outer side 58 of the surface 54 of the fuel distribution ring 27. The two arms 62 of the essentially y-shaped slot 60 may however also be oriented toward the inner side 56 of the surface 54 of the fuel distribution ring 27. Alternating sequences are also possible.

In addition, recesses 66 are arranged on the surface 54 (FIG. 5). These recesses 66 are arranged on the surface 54 such that they also partially include the outer side 58 of the fuel distribution ring 27, in other words a recess exists from the outer side 58 of the fuel distributor 27. The recess 6 may vary in terms of its depth and shape. It is nevertheless preferably an essentially round recess 66.

Here the recesses 66 may comprise a radius and the radius may reduce when viewed in the flow direction. The high thermal gradient during operation and stresses occurring as a result can therefore be even more effectively prevented.

The fuel distribution ring 27 preferably includes at least one nickel alloy, in particular a nickel molybdenum alloy. This material is particularly resistant to heat and is thus particularly well suited to the burner.

The inventive burner assembly may be used in particular in a gas turbine.

Operation-specific high stresses on the fuel distribution ring 27 can be prevented by means of the at least one inventive slot 60 on the surface 45 of the fuel distribution ring 27 between the fuel nozzle 29 and the recess.

An improved heat distribution in the fuel distribution ring material is produced by this essentially better geometry of the fuel distribution ring 27. The improved heat distribution ensures that excessive stresses no longer occur. Significantly extended life cycles result.

It is therefore possible to improve the stresses in this region from over 950 MPa to 600 MPa.

These inventive slots 60 and recesses 66 may, in manufacturing terms, be integrated into already existing fuel distribution rings 27, since they do not require drastic rebuilding and can thus be easily implemented in manufacturing terms. There is therefore minimal influence on the previous aero performance of the burner.

The invention claimed is:

1. A burner assembly, comprising:

a fuel distribution ring;

a plurality of fuel nozzles which are mounted on the fuel distribution ring in the flow direction, wherein the fuel distribution ring comprises an annular surface in the flow direction, wherein the fuel distribution ring comprises an outer inner side oriented toward the ring center and an opposite outer outer side, wherein a slot exists on a surface between the plurality of fuel nozzles, wherein the slot on the surface extends from the outer outer side to the outer inner side, and wherein a recess is arranged on the annular surface and the recess partially also includes the outer outer side of the fuel distribution ring.

2. The burner assembly as claimed in claim 1, wherein the slot is present between each adjacent fuel nozzle.

3. The burner assembly as claimed in claim 1, wherein the slot is essentially y-shaped.

4. The burner assembly as claimed in claim 3, wherein the y-shaped slot includes two arms and a leg and the two arms of the essentially y-shaped slot orientate towards the outer outer side of the fuel distribution ring.

5. The burner assembly as claimed in claim 3, wherein the y-shaped slot includes two arms and a leg and the two arms of the essentially y-shaped slot orient toward the outer inner side of the fuel distribution ring.

6. The burner assembly as claimed in claim 1, wherein the recess is essentially round.

7. The burner assembly as claimed in claim 1, wherein the recess includes a radius and the radius reduces when viewed in the flow direction.

8. The burner assembly as claimed in claim 1, wherein the fuel distribution ring includes at least one nickel alloy.

9. The burner assembly as claimed in claim 8, wherein the fuel distribution ring includes at least one nickel molybdenum alloy.

10. The burner assembly as claimed in claim 1, wherein the fuel distribution ring includes at least two fuel channels for two combustion stages in its interior.

11. The burner assembly as claimed in claim 10, wherein the two fuel channels include two supply connections.

12. A gas turbine, comprising:

a burner assembly as claimed in claim 1.

13. The gas turbine as claimed in claim 12, wherein the slot is present between each adjacent fuel nozzle.

14. The gas turbine as claimed in claim 12, wherein the slot is essentially y-shaped.

15. The gas turbine as claimed in claim 14, wherein the y-shaped slot includes two arms and a leg and the two arms of the essentially y-shaped slot orientate towards the outer outer side of the fuel distribution ring.

16. The gas turbine as claimed in claim 14, wherein the y-shaped slot includes two arms and a leg and the two arms of the essentially y-shaped slot orient toward the outer inner side of the fuel distribution ring.

17. The gas turbine as claimed in claim 12, wherein the recess is essentially round.

18. The gas turbine as claimed in claim 12, wherein the recess includes a radius and the radius reduces when viewed in the flow direction.

19. The gas turbine as claimed in claim 12, wherein the fuel distribution ring includes at least one nickel alloy.

20. The gas turbine as claimed in claim 19, wherein the fuel distribution ring includes at least one nickel molybdenum alloy.

* * * * *